US007374800B2

(12) United States Patent
Burch et al.

(10) Patent No.: US 7,374,800 B2
(45) Date of Patent: May 20, 2008

(54) PRINT MEDIA FOR INK-JET APPLICATIONS HAVING IMPROVED IMAGE QUALITY

(76) Inventors: Eric L. Burch, 16399 W. Bernardo Dr., San Diego, CA (US) 92127; Douglas E. Knight, 16399 W. Bernardo Dr., San Diego, CA (US) 92127

( * ) Notice: Subject to any disclaimer, the term of this patent is extended or adjusted under 35 U.S.C. 154(b) by 0 days.

(21) Appl. No.: 11/055,289

(22) Filed: Feb. 9, 2005

(65) Prior Publication Data

US 2006/0177608 A1 Aug. 10, 2006

(51) Int. Cl.
*B41M 5/40* (2006.01)

(52) U.S. Cl. ..... 428/32.3; 428/32.24; 428/32.25; 428/32.29; 428/32.35

(58) Field of Classification Search ..... 428/32.24, 428/32.25, 32.3, 32.35, 32.29
See application file for complete search history.

(56) References Cited

U.S. PATENT DOCUMENTS 5,750,200 A * 5/1998 Ogawa et al. ..... 427/361
6,177,177 B1 * 1/2001 Herrmann et al. ..... 428/212
6,492,005 B1 * 12/2002 Ohbayashi et al. ..... 428/32.29
6,777,039 B2 * 8/2004 Koike et al. ..... 428/32.26
2003/0059584 A1 3/2003 Onishi et al.
2004/0033377 A1 * 2/2004 Koenig ..... 428/458

FOREIGN PATENT DOCUMENTS

GB 2 301 845 A * 12/1996

* cited by examiner

*Primary Examiner*—Betelhem Shewareged

(57) ABSTRACT

A printing arrangement can include an ink-receiving coating applied to a media substrate, the ink-receiving coating having a coating thickness being configured to have a concentration gradient relative to the thickness. In the concentration gradient, the concentration of a cationic agent is greater in a center region of the ink-receiving coating relative to an upper region and a lower region.

14 Claims, 1 Drawing Sheet

PRINT MEDIA FOR INK-JET APPLICATIONS HAVING IMPROVED IMAGE QUALITY

FIELD OF THE INVENTION

The present invention relates generally to ink-jet printing. More particularly, the present invention relates to the preparation of media coatings for ink-jet applications, which includes a stratified coating formed on a media substrate that uses cationic agent, particulate matter, binder, and other optional ingredients.

BACKGROUND OF THE INVENTION

Ink-jet inks typically comprise an ink vehicle and a colorant, the latter of which may be a dye or a pigment. Dye-based ink-jet inks used in photographic image printing are usually water-soluble dyes. As a result, such dye-based ink-jet inks are usually not very water fast, i.e. images tend to shift in hue and edge sharpness is reduced upon exposure to humid conditions, especially when printed on media substrates having a porous ink-receiving coating. In addition, images created from these water-soluble dye-based ink-jet inks tend to fade over time, such as when exposed to ambient light and/or air. Pigment-based inks on the other hand, allow the creation of images that are vastly improved in humid fastness and image fade resistance. Pigment based images, however, are inferior to dye-based ink-jet inks with respect to the desirable trait of color saturation and penetration of colorant below a coating surface.

Print media surfaces play a key role in fade properties, humid fastness, and the quality of ink-jet produced printed images. Thus, for a given ink, the degree of air fade, humid fastness, haze, and image quality in general can be dependent on the chemistry of the media surface. As a result, many ink-jet inks can be made to perform better when an appropriate media surface is used.

There are benefits of treating silica or other particulates with cationic agents in connection with ink-jet coatings. However, increasing the level of these cationic agents can also result in a decreased porosity, increased haze, lower gamut, and precipitation of ink dye or pigments on the surface of the media, often resulting in poor smudging and poor color properties.

SUMMARY OF THE INVENTION

In accordance with embodiments of the present invention, various methods can be used to provide coated media substrates that do not interact unfavorably with dye-based or pigment-based ink-jet inks. As such, a printing arrangement can comprise an ink-receiving coating applied to a media substrate, the ink-receiving coating having a coating thickness being configured to have a concentration gradient relative to the thickness. The concentration of a cationic agent can be greater in a center region of the ink-receiving coating relative to an upper region and a lower region.

In another embodiment, an ink-receiving coating formed on a media substrate can comprise an upper layer, an intermediate layer, and a lower layer. The intermediate layer can be formed between the upper layer and the lower layer. The upper layer can contain a first concentration of a cationic agent and the intermediate layer can contain a second concentration of the cationic agent which is higher than the first concentration, and which is selected to induce precipitation of at least one colorant in an ink applied to the upper layer.

Additional features and advantages of the invention will be apparent from the following detailed description which illustrates, by way of example, features of the invention.

DETAILED DESCRIPTION OF THE PREFERRED EMBODIMENT(S)

Figure 1:
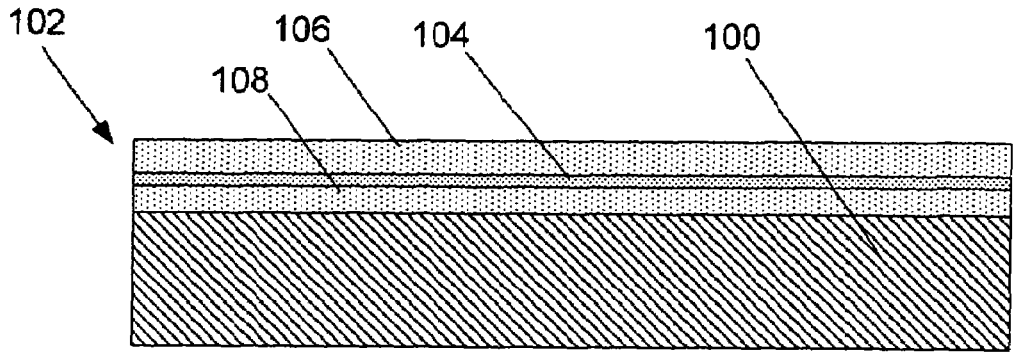
FIG. 1 illustrates a schematic sectional view of a substrate according to an embodiment of the present invention, the substrate having a three layer porous coating applied thereto, wherein an upper layer and a lower layer of the coating has a lower concentration of cationic agent than that of the intermediate or middle layer.

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a dye" includes reference to one or more of such materials.

"Media substrate" or "substrate" includes any substrate that can be coated for use in the ink-jet printing arts including papers, overhead projector plastics, coated papers, fabric, art papers, e.g., water color paper, and the like. "Porous media coating" typically includes inorganic particulates, such as silica or alumina particulates, bound together by a polymeric binder. Optionally, mordants and/or other additives can also be present. Such additives can be water soluble coating formulation additives including multivalent salts, such as aluminum chlorohydrate; organosilane reagents chemically attached or unattached to the inorganic particulates; and/or acidic components such as acidic crosslinking agents. An example of an acidic crosslinking agent that can be used to crosslink a polymeric binder, such as polyvinyl alcohol, is boric acid. The composition can be used as a coating for various media substrates, and can be applied by any of a number of methods known in the art. Additionally, such compositions can be applied in single layer or in multiple layers. If multiple layers are applied, then these multiple layers can be of the same or similar composition, or can be of different compositions.

"Multivalent salt" refers to any of a number of salts that are least divalent, including divalent salts, trivalent salts, etc.

"Aluminum chlorohydrate," "ACH," "polyaluminum chloride," "PAC," "polyaluminum hydroxychloride," or the like, refers to a class of soluble aluminum products in which aluminum chloride has been partly reacted with a base. The relative amount of OH compared to the amount of Al can determine the basicity of a particular product. The chemistry of ACH is often expressed in the form $Al_n(OH)_mCl_{(3n-m)}$, wherein n can be from 1 to 50, and m can be from 1 to 150. Basicity can be defined by the term m/(3n) in that equation. ACH can be prepared by reacting hydrated alumina $AlCl_3$ with aluminum powder in a controlled condition. The exact composition depends upon the amount of aluminum powder used and the reaction conditions. Typically, the reaction can be carried out to give a product with a basicity of 40% to 83%. ACH can be supplied as a solution, but can also be supplied as a solid.

There are other ways of referring to ACH, which are known in the art. Typically, ACH comprises many different molecular sizes and configurations in a single mixture. An exemplary stable ionic species in ACH can have the formula $[Al_{12}(OH)_{24}AlO_4(H_2O)_{12}]^{7+}$. Other examples include $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc. Other common names used to describe ACH or components that can be present in an ACH composition include Aluminum chloride hydroxide (8Cl); A 296; ACH 325; ACH 331; ACH 7-321; Aloxicoll; Aloxicoll LR; Aluminium hydroxychloride; Aluminol ACH; Aluminum chlorhydrate; Aluminum chlorohydroxide; Aluminum chloride hydroxide oxide, basic; Aluminum chloride oxide; Aluminum chlorohydrate; Aluminum chlorohydrol; Aluminum chlorohydroxide; Aluminum hydroxide chloride; Aluminum hydroxychloride; Aluminum oxychloride; Aquarhone; Aquarhone 18; Astringen; Astringen 10; Banoltan White; Basic aluminum chloride; Basic aluminum chloride, hydrate; Berukotan AC-P; Cartafix LA; Cawood 5025; Chlorhydrol; Chlorhydrol Micro-Dry; Chlorhydrol Micro-Dry SUF; E 200; E 200 (coagulant); Ekoflock 90; Ekoflock 91; GenPac 4370; Gilufloc 83; Hessidrex WT; HPB 5025; Hydral; Hydrofugal; Hyper Ion 1026; Hyperdrol; Kempac 10; Kempac 20; Kemwater PAX 14; Locron; Locron P; Locron S; Nalco 8676; OCAL; Oulupac 180; PAC; PAC (salt); PAC 100W; PAC 250A; PAC 250AD; PAC 300M; PAC 70; Paho 2S; PALC; PAX; PAX 11S; PAX 16; PAX 18; PAX 19; PAX 60p; PAX-XL 1; PAX-XL 19; PAX-XL 60S; PAX-XL 61S; PAX-XL 69; PAX-XL 9; Phacsize; Phosphonorm; (14) Poly (aluminum hydroxy) chloride; Polyaluminum chloride; Prodefloc AC 190; Prodefloc AL; Prodefloc SAB 18; Prodefloc SAB 18/5; Prodefloc SAB 19; Purachem WT; Reach 101; Reach 301; Reach 501; Sulzfloc JG; Sulzfloc JG 15; Sulzfloc JG 19; Sulzfloc JG 30; TAI-PAC; Taipac; Takibine; Takibine 3000; Tanwhite; TR 50; TR 50 (inorganic compound); UPAX 20; Vikram PAC-AC 100S; WAC; WAC 2; Westchlor 200; Wickenol 303; Wickenol CPS 325 Aluminum chlorohydrate $Al_2ClH_5O_5$ or $Al_2(OH)_5Cl.2H_2O$ or $[Al(OH)_2Cl]_x$ or $Al_6(OH)_{15}Cl_3$; $Al_2(OH)_5Cl]_x$ Aluminum chlorohydroxide; Aluminum hydroxychloride; Aluminum chloride, basic; Aluminum chloride hydroxide; $[Al_2(OH)_nCl_{6-n}]_m$; $[Al(OH)_3]_nAlCl_3$; or $Al_n(OH)_mCl_{(3n-m)}$ (where generally, $0<m<3n$); for example. In one embodiment, preferred compositions include aluminum chlorides and aluminum nitrates of the formula $Al(OH)_2X$ to $Al_3(OH)_8X$, where X is Cl or $NO_3$. In another embodiment, preferred compositions can be prepared by contacting silica particles with an aluminum chlorohydrate ($Al_2(OH)_5Cl$ or $Al_2(OH)Cl_5.nH_2O$). It is believed that contacting a silica particle with an aluminum compound as described above causes the aluminum compound to become associated with or bind to the surface of the silica particles. This can be either by covalent association or through an electrostatic interaction to form cationic charged silica, which can be measured by a Zeta potential instrument.

The term "ink-receiving coating" refers to a layer or multiple coating layers that is/are applied to a media substrate, and which is/or configured to receive ink upon printing. In accordance with embodiments of the present invention, the thickness of the coating can be configured to have a concentration gradient with respect to a cationic agent present in the coating, wherein a greater concentration of the cationic agent is present within outer coating layers or regions, e.g., toward the center of the coating thickness.

The term "concentration gradient" or "concentration strata" refers to concentration differentials relative to the thickness of an ink-receiving coating. In accordance with embodiments of the present invention, the concentration gradient will have a greater concentration of cationic agent-treated particulates at an intermediate layer or region with respect to other areas below and above the intermediate layer or region. Typically, this intermediate layer or region where the concentration is greater can be thinner than the areas below or above this layer or region.

The term "about" when referring to a numerical value or range is intended to encompass the values resulting from experimental error that can occur when taking measurements.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of about 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

With this in mind, it has been discovered that cationic agents in ink-jet media coatings function to bind and precipitate the anionic dyes in inks. This can impart improved properties of waterfastness, humidfastness, fade, and color gamut. In accordance with this recognition, the level of cationic agent can play a role in these functions. For example, too little cationic agent can result in incomplete dye precipitation, increased dye penetration, and loss of gamut as well as poor water fastness and fade. Alternatively, adding too much cationic agent can cause haze and loss of coating transparency, which can reduce color gamut. Controlling where the cationic agent binds the dye can also affect performance. Binding the dyes too near the surface can cause bronzing and water smudge issues. Allowing dyes to penetrate to deeply into a media coating can decrease color gamut. Thus, the location, strength of binding power, and thickness of binding locations within an ink-receiving coating can play a role in achieving high image quality.

As such, the present invention is drawn to a printing arrangement which can comprise an ink-receiving coating applied to a media substrate, the ink-receiving coating having a coating thickness being configured to have a concentration gradient relative to the thickness. The concentration of a cationic agent can be greater in a center region of the ink-receiving coating relative to an upper region and a lower region.

In another embodiment, an ink-receiving coating formed on a media substrate can comprise an upper layer, an intermediate layer, and a lower layer. The intermediate layer can be formed between the upper layer and the lower layer. The upper layer can contain a first concentration of a cationic agent and the intermediate layer can contain a second concentration of the cationic agent which is higher than the first concentration, and which is selected to induce precipitation of at least one colorant in an ink applied to the upper layer.

It has been found that by varying the concentration of a cationic agent within an ink-receiving coating formed of particles and binder, improved coating and printing properties can be achieved. It will be noted that the term cationic agent is used throughout the disclosure and is used in the sense that it includes cations, typically from multivalent salts or cationic polymers.

Figure 2:
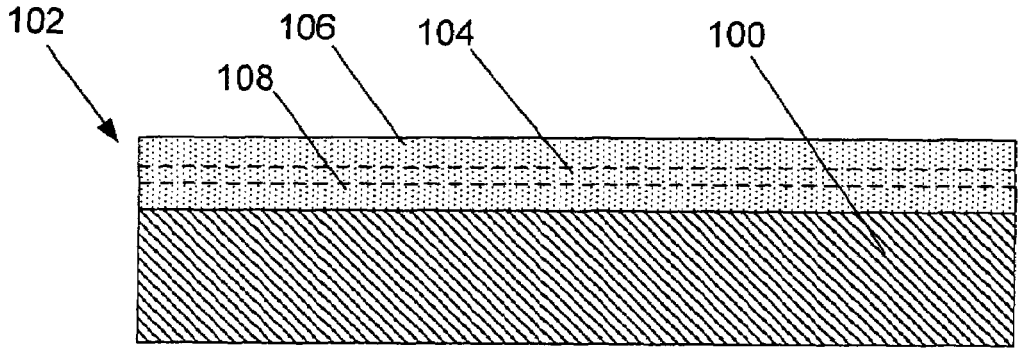
FIG. 2 illustrates a schematic sectional view of a substrate according to an embodiment of the present invention, the substrate having a single layer porous coating applied thereto, wherein an upper region and a lower region of the coating has a lower concentration of cationic agent than that of an intermediate region.

This cationic agent concentration stratification or gradient can be achieved in accordance with a multilayer embodiment, e.g., FIG. 1, or alternatively, by a single layer embodiment having a higher concentration of the cationic agent toward the center of the layer, e.g., FIG. 2. Regarding FIG. 1, as will be appreciated, the medium or media substrate 100 can have a multilayer coating 102 including an intermediate high concentration layer 104 sandwiched between a top layer 106 and a bottom layer 108, each of which have a lower concentration than the intermediate high concentration layer. The coatings which are used in the formation of these layers can be prepared, merely by way of example, using the application of a surface wash wherein the wash solution removes the cationic species that is present in a larger amount in the upper layer under the conditions that the wash solution volume is less than the pore volume, resulting in a surface that is depleted of cationic agent. Alternatively, the bottom layer or the top layer can be prepared to include less of the cationic agent than the intermediate layer. Further, different cationic agent concentrations can also be used to prepare the coating for the different layers. Though three layers are shown in FIG. 1, it will be appreciated that other multiple layer coating embodiments are also possible, as will be described by example hereinafter.

Regarding FIG. 2, the media substrate 100 can have a single layer coating 102 including an intermediate high concentration region 104 sandwiched between a top region 106 and a bottom region 108, each of which have a lower concentration than the intermediate high concentration region. In other words, in this embodiment, it is noted that while the cationic agent and binder exist as a continuous but non-homgeneous mixture, and is not necessarily configured as discretely layered. With this embodiment, similar principles apply to this embodiment as apply to the previous embodiment.

In other embodiments that are not shown in the FIGS., varied concentrations in one or more layer can be prepared using a cationic agent that diffuses into the one or more layer from above and/or below, but does not fully diffuse therein to the extent that it is homogenous throughout the layer. Alternatively, in a two layered system, an upper layer can be infiltrated with or configured to include a cationic agent, and a lower layer can be free of cationic agent. In this configuration, the upper layer can be surface-washed, resulting in the removal of some of the cationic agent from the surface, and in more detail, from the surface to predetermined depth from the surface. A third method of varying the density of the cationic layer is to use more than three for the ink-receiving coating, e.g., four to nine, with the net result of having a cationic agent concentraton higher toward the middle of the layer stack versus the top and bottom portions of the stack.

Contrary to the above-described embodiments, a disadvantage of forming a gradient having a single underlayer layer that contains a high level of cationic agent is that the cationic molecules in such a configuration tend to produce haze. Minimizing the concentration of the cationic agent decreases haze and increases gamut. Maximizing the agent in a single interior region ensures the dye is precipitated while minimizing the negative effects of haze.

The particles which are used to form the layers (FIG. 1) or regions (FIG. 2) 104, 106, 108 are not limited to silica, as the particles can be other semi-metal oxide or metal oxide particulates, such as aluminum hydroxide, or even other types of particulates such as plastic pigments.

With more specific reference to the semi-metal or metal oxide particulates, such particulates that can be selected for use include silica, alumina, titania, zirconia, aluminum silicate, calcium carbonate, and/or other naturally occurring pigments. These compositions can be in various forms and in various shapes; for example, silica can be fumed silica, colloidal silica, precipitated silica, or grounded silica gel, depending on the affect that is desired to achieve. Generally, the semi metal oxide or metal oxide particulates can be from 30 nm to 500 nm in size, or in one embodiment, from 200 nm to 350 nm, depending on the desired application. Alternatively, in one embodiment, 30 nm to 100 nm spherical silica particulates can be used to provide a glossy appearance, whereas larger less spherical particulates can provide a less glossy appearance. More irregular shapes, on the other hand, can provide more voids between particles than may be present with tightly packed spherical particulates.

The use of other coating materials can be optionally present in the embodiments of the invention. Such other additional coating ingredients that can be used include binders, surfactants, plasticizers, dyes, friction modifiers, color fade stabilizers, and other additives known in the art.

Regarding binders specifically, as the semi-metal or metal oxide particulates are not self-adherent, typically, a binder is added to the composition to bind the particulates together. An amount of binder is typically added that provides a balance between binding strength and maintaining particulate surface voids and inter-particle spaces for allowing ink to be received. Exemplary binders that can be used include polyvinyl alcohol, both fully hydrolyzed and partially hydrolyzed, such as Airvol supplied by Air Product or Mowiol supplied by Clariant; modified polyvinyl alcohols, such as acetoacetylated polyvinyl alcohols commercially available as the GOHSEFIMER Z series from Nippon Gohsei; amine modified polyvinyl alcohol; and polyvinyl alcohol modified by silane coupling agent. Other binders that can be used include polyester, polyester-melanine, styrene-acrylic acid copolymers, styrene-acrylic acid-alkyl acrylate copolymers, styrene-maleic acid copolymers, styrene-maleic acid-alkyl acrylate copolymers, styrene-methacrylic acid copolymers, styrene-methacrylic acid-alkyl acrylate copolymers, styrene-maleic half ester copolymers, vinyl naphthalene-acrylic acid copolymers, vinyl naphthalene-maleic acid copolymers, and salts thereof. In some embodiments, it can be more desirable to use polyvinyl alcohol and/or modified polyvinyl alcohol as the interaction between the binder and silica is very strong, resulting in a formed coating that is substantially water insoluble.

To improve the binding strength of the binder, a crosslinking agent, such as boric acid, can be added to the coating composition. When a crosslinking agent is used, less binder may be required for use. Other crosslinking agents that can be used include borate salt, titanium salt, vanadium and chromium salts, melamine formaldehyde, glyoxal, thiourea formaldehyde, and Curesan. Though a purpose of the invention is to remove unreacted water soluble coating formulation additives, this does not mean that only water soluble coating formulation additive must be used, as other formulation additives that do not interfere with print quality can also be used therewith.

In accordance with the above embodiments, the semi-metal oxide or metal oxide particulates can be admixed or treated with multivalent salt(s). Exemplary salts that can be added to coating compositions to provide benefit to the coating composition, but which should be removed from the coating composition if excess amounts are present include aluminum salts, such as aluminum chlorohydrate, and trivalent or tetravalent metal oxides with metals such as aluminum, chromium, gallium, titanium, and zirconium. Alternatively, if such multivalent salt(s) generate unwanted or interfering electrolytes, those electrolytes can alternatively or additionally be removed. In one embodiment, if aluminum chlorohydrate is used, it can be present in the coating composition at from 2 wt % to 20 wt % compared to the silica content, and in a more detailed embodiment, the aluminum chlorohydrate can be present at from 5 wt % to 10 wt %.

In addition to the salt groups that can be added, the semi-metal or metal oxide particulates can also be modified with organic groups. Specifically, organosilane reagents can be added to the surface-activated silica to add additional positively charged moieties to the surface, or to provide another desired function at or near the surface, e.g., ultraviolet absorbers, chelating agents, hindered amine light stabilizers, reducing agents, hydrophobic groups, ionic groups, buffering groups, or functionalities for a subsequent reaction. As these reagents are primarily organic, they can provide different properties with respect to ink-jet ink receiving properties.

Returning to FIGS. 1 and 2, the intermediate higher concentration layer or region 104 contains one or more cationic agents in a concentration sufficient to induce substantial precipitation or localization of at least one colorant which comes into contact therewith and therefore before actually reaching the media substrate 100, which is separated therefrom by the lower concentration layer or region 108. The semi-metal oxide or metal oxide type of particulate matter used in this layer or region 108 can have a single coating of a cationic material, such as a salt or organic polymer directly on the surface of a particle and/or which has been permitted to diffuse to a degree into the areas between the particles or into the binder.

As noted above, the gradient or strata permits dyes to precipitate and concentrate at a penetration depth at which the concentration is sufficient to precipitate the dye. In the case of the multi-layer embodiment the precipitation will usually occur at or just below the interface between the upper and intermediate layers/regions 106, 104, respectively. The layers/regions 106, 108 above and below the intermediate layer/region 104 contain concentrations of cationic agent which are insufficient to induce a significant degree of precipitation.

The cationic agent gradient/strata can be detected by scraping the coating and measuring atomic concentrations of the cationic agents (elemental analysis) or cationic polymer (carbon-nitrogen ratios) as a function of scraping depth. Alternatively, gradients can be detected by XPS (X-ray Photoelectron Spectroscopy) mapping of a coating cross section.

As stated, the particulate matter used in the embodiments of the invention includes semi-metal oxide or metal oxide particulates, plastic particulates, or the like. In one embodiment, the particulate matter can be fumed silica. This material can have having a secondary order particle size range of 30 nm to 500 nm, or a particle size from 150 nm to 350 nm in order to maintain gloss and porosity, as measured by a scanning electron microscope (SEM). The same type of silica can be used for each of the layers or regions 104, 106, and 108. However, other types of silica or other particulates can be present in the coatings. In this case, the coating techniques can be varied as may be desirable for a specific application.

If silica is used, and the silica is of the same type in each layer or region, the surface area of the silica particles can vary, however in one embodiment, the surface area of the silica within each layer is either close is measurement or essentially the same.

The cationic agents which are used in the embodiments of the invention can comprise multivalent type salts, e.g., divalent, trivalent, etc. By way of example, trivalent cations like aluminum salts such as aluminum chlorohydrate (ACH) can be used. The cationic polymers are generally of the primary, secondary, tertiary, or quaternary amine type.

A cationic agent level used to cause precipitation in the intermediate level can be from 5 wt % to 25 wt % based on the amount of particulates. A range of 5 wt % to 15 wt % can also be used. In one embodiment, in the upper and lower layers/regions of the coating, the cationic agent can present in amount less than that required for precipitation, allowing penetration through the upper layer. In still another embodiment, at least one dye of an ink-jet ink set can be configured to be excluded from the lower layer. The levels of cationic agent present in the upper or lower layer/region will typically be from 0.1 wt % to 10 wt %, with the proviso that the upper and lower level concentrations are both less than the intermediate layer/region concentration.

The embodiments of the invention are not limited to any particular cationic agent concentration gradient or strata, provided a greater concentration is present in a region between the outer layers or regions of the ink-receiving coating. The gradient can occur by multiple layers with varying ACH concentration, diffusing of ACH from one layer into another, or from a washing step on a dried coating that washes the cationic agent (e.g. ACH), particularly from a top layer or region.

Multi-layer embodiments such as schematically depicted in the figure can be produced using single pass multilayer coating methods like curtain or cascade coating, or through a two pass single layer design using slot coating, meyer rod, cast coating, or the like. Coating materials can be formed in the manner noted above and in a manner wherein the concentration of the cationic agent is appropriately set.

Ink-jet ink compositions that can be used to print on the coated media compositions of the present invention are typically prepared in an aqueous formulation or liquid vehicle which can include water, co-solvents, surfactants, buffering agents, biocides, sequestering agents, viscosity modifiers, humectants, binders, and/or other known additives. Colorants, such as dyes and/or pigments are also present to provide color to the ink-jet ink. In one aspect of the present invention, the liquid vehicle can comprise from about 70 wt % to about 99.9 wt % of the ink-jet ink composition. In another aspect, other than the colorant, liquid vehicle can also carry polymeric binders, latex particulates, and/or other solids.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what are presently deemed to be the most practical and preferred embodiments of the invention.

Example 1

A method of preparing one or more layer(s) of an ink-receiving coating that includes silica, a cationic agent (ACH), and a binder is set forth below. This preparation can be carried out in two stages. The first stage includes coating the silica with ACH. The second stage includes adding the binder and other ingredients.

Stage 1:

1) Charge deionized water (DI) into a mixing vessel;

2) Add ACH to the deionized water and increase the pH with a suitable base until completely dispersed with stirring. Note that the stirrer should use a high shear mixing blade and that the diameter of the blade should be at least 50% of the mixing vessel diameter. The mixer should rotate fast enough to produce a vortex. The ACH should be added to produce a concentration selected to be in the range of 5 wt % to 15 wt % based on silica added in next step.

3) Add silica slowly and at a constant rate while continuing to stir. Care should be taken in order to avoid clumping as this can detrimentally affect the outcome of the silica dispersion. Note that as the silica is added, the viscosity of the mixture will increase and it will be necessary to adjust the rate of mixing. As the silica becomes "wetted," the viscosity of the solution decreases, and thus, the mixer speed should be monitored and adjusted accordingly. The viscosity of the mix should be around 40 Cp at 100 RPM; the pH should be about 4.0; and the temperature should be about 40° C.

Stage 2

1) Charge deionized water (DI) into a mixing vessel.

2) Add PVA solution while stirring gently to avoid entrainment of air, in an amount sufficient to produce a concentration of about 20% to 25% by wt silica and continue to stir for about 1 minute.

3) Add glycerol in an amount sufficient to produce a concentration of about 0.5 wt % to 5 wt % silica, and continue to stir for about 1 minute.

4) Add surfactant (Nonionic, Low Foaming Liquid Surfactant, such as Nonionic, Nonylphenoxy Ethanol (Alkylphenol Ethoxylate manufactured by OLIN Corporation) in an amount to produce a concentration of about 0.0005 to 0.01 gm/cc and continue to stir for about 1 minute.

5) Add the product from stage one into the above solution very slowly and allow to mix for amount 3 minutes.

6) Add boric acid very slowly, e.g., dropwise, while mixing fast enough to turn the solution over but avoid the entrainment of air. Continue to mix for about 5 minutes to ensure uniformity. Note that boric is a crosslinker that forms low level of links in solution, but is driven to completion by loss of water on drying. The endpoint includes the boric crosslinking the PVA in the dry coating. The effectiveness of boric is a function of pH and type of PVA.

Example 2

The coated silica-containing coating composition prepared in accordance with Example 1 can be coated on a media substrate by one of many methods, including a method where the coating is drawn down onto a media substrate, as follows:

Drawdown method for forming a 25 g/m$^2$ coating.

1) Calculate Meir Rod Number to use from the % solids (wet) form.

2) Perform draw down on a precut sheet 9 m gell subcoat photopaper base.

3) Dry the sheet with a hot air gun set at medium power. When the phase transition of wet coating flashing to dry coating appears, transfer the sheet to a cooling tray. When dry, the Ct Wt should be determined by weighing a 100 cm2 disc and comparing this weight to a disc removed from an uncoated sheet.

Three layers can be formed using the above technique. In one embodiment, the top and bottom layers each contain 8.5 wt % ACH and are each formed at 8 g/m$^2$, while the intermediate layer contains 10 wt % ACH and is formed at 8 g/m$^2$.

Example 3

A coating composition was prepared and applied to a media substrate using a process similar to that describe above in Examples 1 and 2. The coating composition included 19 g/m$^2$ fumed silica treated with about 10 wt % aluminum chlorohydrate (ACH), and further included a polyvinyl alcohol binder. The coating composition had a low viscosity of 100 cP at 100 RPM Brookfield, measured at 40° C. The coating composition had 16 wt % solids content. Upon printing a HP DeskJet 970 ink-jet ink onto the coated media, the image exhibited poor dye color and gamut which could not be corrected by simple pH adjustment.

Example 4

A coating composition was prepared and applied to a media substrate using a process similar to that describe above in Examples 1 and 2. The coating composition included 19 g/m$^2$ fumed silica treated with about 8.5 wt % aluminum chlorohydrate (ACH), and further included a polyvinyl alcohol binder. The coating composition had a high viscosity of 450 cp at 100 RPM Brookfield, measured at 40° C. The coating composition had 16 wt % solids content. Upon printing a HP DeskJet 970 ink-jet ink onto the coated media, the image exhibited good color and gamut, but the coating solution had a high viscosity and a high cracking tendency.

Example 5

A dual layer coating composition was prepared and applied to a media substrate using a process similar to that describe above in Examples 1 and 2. A base coating composition included 6 g/m$^2$ fumed silica treated with about 10 wt % aluminum chlorohydrate (ACH), and further included a polyvinyl alcohol binder. The base coating composition had a viscosity of 135 cP at 100 RPM Brookfield, measured at 40° C. The coating composition had 16 wt % solids content. A top coating composition included 6 g/m$^2$ fumed silica treated with about 8.5 wt % aluminum chlorohydrate (ACH), and further included a polyvinyl alcohol binder. The coating composition had 16 wt % solids content as well. The coating system had good viscosity and good overall coating solids for both layers. Upon printing a HP DeskJet 970 ink-jet ink onto the top coating of the coated media, the image exhibited good dye color, but poor haze and gamut.

Example 6

A three layer coating composition, in accordance with embodiments of the present invention, was prepared and applied to a media substrate using a process similar to that describe above in Examples 1 and 2. A base coating composition included 8 g/m$^2$ fumed silica treated with about 8 wt % aluminum chlorohydrate (ACH), and further included a polyvinyl alcohol binder. The base coating composition had a viscosity of 160 cP at 100 RPM Brookfield, measured at 40° C. The coating composition had 16 wt % solids content. A thinner intermediate coating composition included 3 g/m$^2$ fumed silica treated with about 10 wt % aluminum chlorohydrate (ACH), and further included a polyvinyl alcohol binder. The intermediate coating composition had a viscosity of 135 cp at 100 RPM Brookfield, measured at 40° C. The intermediate coating composition had 16 wt % solids content. A top coating composition (of about the same thickness as the bottom coating composition) included 8 g/m$^2$ fumed silica treated with about 8 wt % aluminum chlorohydrate (ACH), and further included a polyvinyl alcohol binder. The base coating composition had a viscosity of 160 cp at 100 RPM Brookfield, measured at 40° C. The coating composition had 16 wt % solids content as well. This example, as also depicted in FIG. 1, provides a system with good viscosity and good overall coating solids for application purposes, and upon printing, exhibits good dye color, low haze, and good gamut.

Example 7

Several coating solutions were prepared from 67 parts by weight Cabot M5 fumed silica, 19 parts by weight Mowiol 2688 polyvinylalcohol, 2.7 parts by weight boric acid, 2 parts by weight glycerol, 0.2 parts by weight Olin 10G, and varying levels Locron aluminachlorohydrate (ACH) cationic agent (0.75, 4, 7.5, 8.1, and 15 parts by weight corresponding respective to 1 wt %, 5 wt %, 10 wt %, 15 wt %, and 20 wt % of the silica) at 14% total solids. The solutions were coated on transparency film at 8 g/m$^2$ and 15 g/m$^2$ dry weights.

Example 8

The five coating solutions prepared in Example 7 were each measured for transparency using the following procedure. Using a Technidyne Corporation Opacimter Model BNL-3 in scattering mode, scattering measures were taken with both a black background and a white background. Using the white background, the reading indicated scattering of light from the sample and light reflected through the sample from the background, and also represents a maximum light scattering value. Conversely, as the black background absorbs all the light that transmitted through the sheet, the value obtained represented a minimum value. The difference between the two indicates the light scattered by the background, and thus, can represent the transparency of the coating. Higher differences between white a black background scattering numbers indicate a more transparent coating. The control sample without coating represents a perfectly transparent coating.

The scattering difference numbers are shown for a 8 g/m$^2$ coating in Table 1 below, and for a 15 g/m$^2$ coating in Table 2 below, as follows:

TABLE 1

| Sample of ACH at 8 g/m$^2$ | Scatter Difference |
|---|---|
| No coating control | 80.1 |
| 1 wt % | 78.1 |
| 10 wt % | 79.6 |
| 15 wt % | 77.6 |
| 20 wt % | 77.7 |

TABLE 2

| Sample of ACH at 15 g/m$^2$ | Scatter Difference |
|---|---|
| No coating control | 80.1 |
| 1 wt % | 78.5 |
| 10 wt % | 78.0 |
| 15 wt % | 74.4 |
| 20 wt % | 72.5 |

Two noticeable trends are apparent from Tables 1 and 2. First, by increasing the cationic agent, the transparency is decreased. Also, by increasing coating weight at the same cationic agent level, the transparency is decreased. Thus, maximizing cationic agent level while maintaining transparency can be achieved from the information provided by this data, as follows:

1) Find the level of cationic agent to precipitate the dyes;

2) Add the cationic agent to a layer below the surface to prevent surface precipitation of the dyes;

3) Minimize the thickness of this layer to minimize losses to transparency; and

4) Add a bottom layer with low cationic agent to absorb excess ink.

Example 9

An ink-receiving coating that incorporates the teachings described in Example 8 can be formulated and prepared as follows. For example, a layer with 5 wt % ACH by weight of silica provides can provide good level of waterfastness, but still allow acceptable dye penetration. Thus, if it is also found that 15% ACH by weight of silica at 5 microns in thickness is sufficient to bind a predetermined dye, while about 30 microns of silica total is needed to absorb the ink vehicle of the ink-jet ink, then appropriate layers of thickness can be prepared. Tables 1 and 2 in Example 8 above indicates that adding thickness to 15% ACH layer over a relatively thin layer, e.g., 8 microns, only decreases coating transparency without increasing dye precipitation at the top of this layer. As a result, a good coating construction in accordance with the teachings of the present invention may include 3 microns of 5% ACH at the surface (top coating), 8 microns of 15% ACH under that layer (intermediate coating), and 19 microns of silica on the bottom (bottom coating) with a very low level of cationic agent (1 wt % ACH) to absorb the balance of the ink.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A printing arrangement comprising:

an ink-receiving coating applied to a media substrate, the ink-receiving coating having a coating thickness being configured to have a concentration gradient relative to the thickness, wherein the concentration of a cationic agent is greater in a center region of the ink-receiving coating relative to an upper region and a lower region, and wherein the upper region, the center region, and the lower region each include the cationic agent, said cationic agent present throughout the ink-receiving coating.

2. A printing arrangement as set forth in claim 1, wherein the lower region is in contact with an upper surface of the media substrate.

3. A printing arrangement as set forth in claim 1, wherein the cationic agent is a metal salt.

4. A printing arrangement as set forth in claim 2, wherein the ink-receiving coating comprises:

a first layer which contains particulate matter coated with a cationic agent;

a second layer which contains particulate matter coated with the cationic agent; and a third layer which contains particulate matter coated with the cationic agent, the third layer being formed between the first and second layers and configured to contain the cationic agent at a concentration which is higher than the concentration of the first and second layers.

5. A printing arrangement as set forth in claim 1, wherein the cationic agent is a multivalent salt.

6. A printing arrangement as set forth in claim 5, wherein the multivalent salt includes a trivalent cation.

7. A printing arrangement as set forth in claim 3, wherein the metal salt comprises aluminum chlorohydrate.

8. A printing arrangement as set forth in claim 4, wherein the cationic agent of the first layer and the second layer comprises aluminum chlorohydrate.

9. A printing arrangement as set forth in claim 4, wherein the cationic agent of the third layer comprises aluminum chlorohydrate.

10. A printing arrangement as set forth in claim 4, wherein the cationic agent of the first layer, the second layer, and the third layer is the same cationic agent.

11. A printing arrangement as set forth in claim 1, wherein the coating contains particulate matter comprising particles having a size from about 30 nm to 500 nm.

12. A printing arrangement as set forth in claim 1, wherein the coating contains particulate matter comprising particles having a size from about 200 nm to 350 mn.

13. A printing arrangement as set forth in claim 1, wherein the coating contains particulate matter comprising semi-metal oxide or metal oxide particulates.

14. A printing arrangement as set forth in claim 1, wherein the semi-metal oxide or metal oxide particulates are fumed silica.

* * * * *

UNITED STATES PATENT AND TRADEMARK OFFICE

CERTIFICATE OF CORRECTION

PATENT NO. : 7,374,800 B2
APPLICATION NO. : 11/055289
DATED : May 20, 2008
INVENTOR(S) : Eric L. Burch et al.

It is certified that error appears in the above-identified patent and that said Letters Patent is hereby corrected as shown below:

On the face page, in field (54), in "Title" in column 1, line 1, after "INK-JET" insert -- INK --.

In column 1, in "Title", line 1, after "INK-JET" insert -- INK --.

In column 14, line 21, in Claim 12, delete "350 mn" and insert -- 350 nm --, therefor.

Signed and Sealed this

Twenty-second Day of June, 2010

David J. Kappos

David J. Kappos
*Director of the United States Patent and Trademark Office*